US008555857B2

(12) United States Patent
Yang et al.

(10) Patent No.: US 8,555,857 B2
(45) Date of Patent: Oct. 15, 2013

(54) METHOD AND APPARATUS FOR CONTROLLING SPARK TIMING IN AN INTERNAL COMBUSTION ENGINE

(75) Inventors: Xiaofeng Yang, Troy, MI (US); Wenbo Wang, Novi, MI (US); Tang-Wei Kuo, Troy, MI (US); Jeffrey M. Kaiser, Highland, MI (US); Chao F. Daniels, Superior Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 374 days.

(21) Appl. No.: 12/947,103

(22) Filed: Nov. 16, 2010

(65) Prior Publication Data

US 2012/0118266 A1 May 17, 2012

(51) Int. Cl.
*F02P 5/00* (2006.01)

(52) U.S. Cl.
USPC ..... 123/406.26

(58) Field of Classification Search
USPC ..... 123/329, 339.11, 406.11, 406.12, 123/406.23–406.27, 406.33, 406.57, 123/406.28, 406.44, 406.45, 406.47; 701/101–105, 109; 73/114.08, 114.09; 702/182
See application file for complete search history.

(56) References Cited

U.S. PATENT DOCUMENTS

| | | | | |
|---|---|---|---|---|
| 4,584,978 | A * | 4/1986 | Sasaki et al. | 123/406.65 |
| 4,587,938 | A * | 5/1986 | Kobayashi et al. | 123/406.44 |
| 4,893,600 | A * | 1/1990 | Holmes | 123/406.2 |
| 4,899,282 | A * | 2/1990 | Holmes | 701/111 |
| 5,383,432 | A | 1/1995 | Cullen et al. | |
| 5,640,939 | A * | 6/1997 | Shimada et al. | 123/306 |
| 5,660,157 | A * | 8/1997 | Minowa et al. | 123/344 |
| 5,752,485 | A * | 5/1998 | Minowa et al. | 123/399 |
| 5,755,205 | A * | 5/1998 | Nishimura et al. | 123/406.24 |
| 5,769,053 | A * | 6/1998 | Nonaka | 123/406.44 |
| 5,778,855 | A * | 7/1998 | Czekala et al. | 123/406.27 |
| 5,867,983 | A * | 2/1999 | Otani | 60/276 |
| 5,887,570 | A * | 3/1999 | Suzuki et al. | 123/406.44 |
| 6,460,508 | B1 * | 10/2002 | Oder | 123/295 |
| 6,687,591 | B2 * | 2/2004 | Abe | 701/54 |
| 7,347,195 | B2 * | 3/2008 | Biljenga | 123/620 |
| 7,472,687 | B2 * | 1/2009 | Zhu et al. | 123/406.34 |
| 2002/0185086 | A1 * | 12/2002 | Newman et al. | 123/1 A |
| 2007/0186903 | A1 * | 8/2007 | Zhu et al. | 123/406.37 |

FOREIGN PATENT DOCUMENTS

JP 10318110 A * 12/1998

OTHER PUBLICATIONS

English translation of JP 10318110 A.*

* cited by examiner

*Primary Examiner* — Stephen K Cronin
*Assistant Examiner* — Joseph Dallo

(57) ABSTRACT

A method for operating a spark-ignition internal combustion engine includes controlling spark ignition timing responsive to a combustion charge flame speed corresponding to an engine operating point and a commanded air/fuel ratio associated with an operator torque request.

13 Claims, 8 Drawing Sheets

METHOD AND APPARATUS FOR CONTROLLING SPARK TIMING IN AN INTERNAL COMBUSTION ENGINE

TECHNICAL FIELD

This disclosure is related to control of internal combustion engines, with reference to controlling spark-ignited internal combustion engines.

BACKGROUND

The statements in this section merely provide background information related to the present disclosure and may not constitute prior art.

Known control schemes for operating internal combustion engines include determining preferred spark ignition timing with reference to piston position over a range of engine speed/load operating conditions. Known spark ignition timing states are described in terms of a spark map, which provides states for minimum spark advance that achieves a maximum brake torque (MBT) at engine operating points defined across an engine speed/load operating range that is determined at a stoichiometric air/fuel ratio. Known engine control systems include an MBT-spark map and a knock-spark map to limit spark timing within an allowable level of knock or pre-ignition under predetermined conditions.

Known control schemes for operating internal combustion engines to change engine torque in response to a vehicle load demand, e.g., an operator torque request, include adjusting intake airflow and varying spark timing.

Known control systems operate in a rich air/fuel ratio region in response to high-load and transient engine conditions. A rapid change in a torque demand may include adjusting spark timing. When an engine is operating at a non-stoichiometric air/fuel ratio, a preferred spark ignition timing must be estimated. An engine operating at a non-optimal estimated spark ignition timing may not produce a maximum achievable torque for the engine operating point when the engine is operating at a non-stoichiometric air/fuel ratio.

Known systems use spark timing compensation, i.e., a spark timing difference between operating at stoichiometric and at rich air/fuel ratios that is equal to that at the MBT timing. This may lead to a poor estimation of spark timing that may cause engine output torque to be less than is achievable during rich engine operation.

SUMMARY

A method for operating a spark-ignition internal combustion engine includes controlling spark ignition timing responsive to a combustion charge flame speed corresponding to an engine operating point and a commanded air/fuel ratio associated with an operator torque request.

BRIEF DESCRIPTION OF THE DRAWINGS

One or more embodiments will now be described, by way of example, with reference to the accompanying drawings, in which.

DETAILED DESCRIPTION

Figure 1:
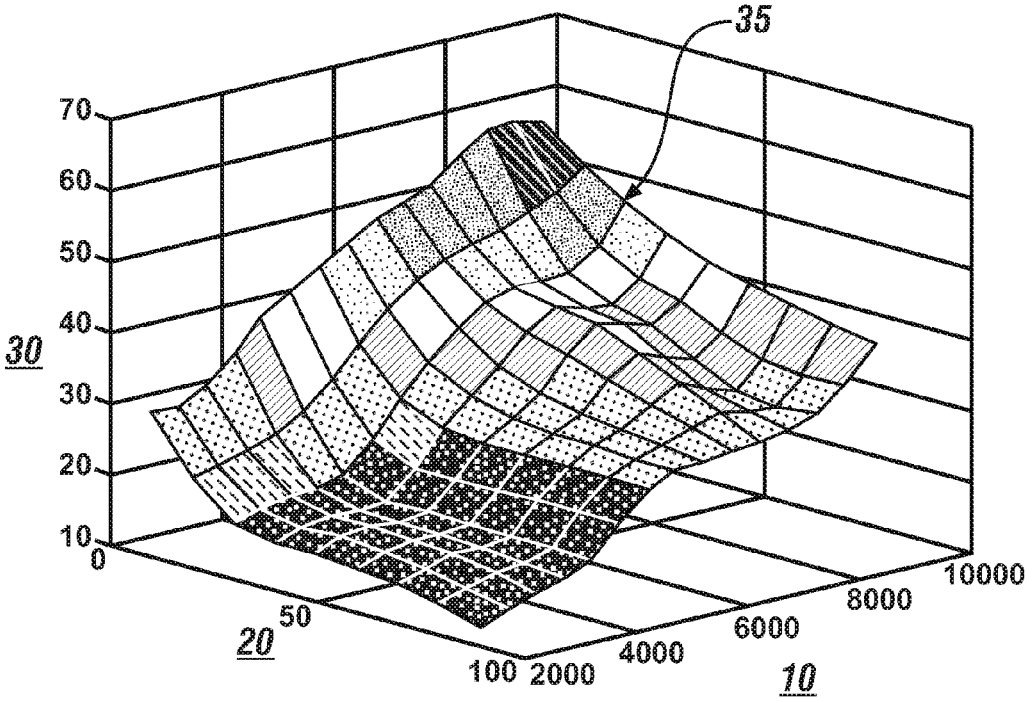
FIG. 1 shows a three-dimensional graphical representation of a spark map for an exemplary internal combustion engine, in accordance with the disclosure.

Referring now to the drawings, wherein the showings are for the purpose of illustrating certain exemplary embodiments only and not for the purpose of limiting the same, FIG. 1 shows a three-dimensional graphical representation of a spark map 35 for an exemplary internal combustion engine, including axes of spark advance (30), engine speed (10), and engine load (20). The spark advance (30) is depicted in units of crank-angle degrees before top-dead center (bTDC), engine speed (10) is depicted in units of engine revolutions per minute or RPM, ranging from 0 to 10,000 RPM, and engine load (20) is depicted in units of throttle or accelerator pedal position, ranging from 0-100% of a wide-open throttle state.

The spark map 35 includes a plurality of initial spark advance settings (30), i.e., spark timing settings for operating an internal combustion engine at a reference air/fuel ratio. Each spark timing setting is preferably a minimum spark advance before top-dead center (bTDC) that achieves maximum brake torque (MBT), and corresponds to an engine operating point described in terms of engine speed (10) and engine load (20). The spark map 35 may be implemented in an engine control scheme as a predefined calibration table executed as a multidimensional array of spark advance settings (30) corresponding to the engine speed (10) and engine load (20), or using another suitable engine control scheme. The spark advance settings (30) are preferably determined across operating ranges of engine speeds (10) and loads (20) using a representative engine that is operating on an engine dynamometer. The spark advance settings (30) are the initial spark advance timings corresponding to engine operating points for operating the engine at a reference air/fuel ratio to achieve MBT, which is stoichiometry in one embodiment. The depicted data is illustrative and not restrictive.

An internal combustion engine may operate at a stoichiometric air/fuel ratio under specific operating conditions in response to operator commands including an operator torque request, and may operate either rich or lean of stoichiometry under other operating conditions. One operating condition includes operating at a rich air/fuel ratio during transient conditions, e.g., during either acceleration events or high-load conditions. The engine air/fuel ratio may be defined and described as an equivalence ratio, which is a ratio of actual or commanded air/fuel ratio and a stoichiometric air/fuel ratio.

Figure 16:
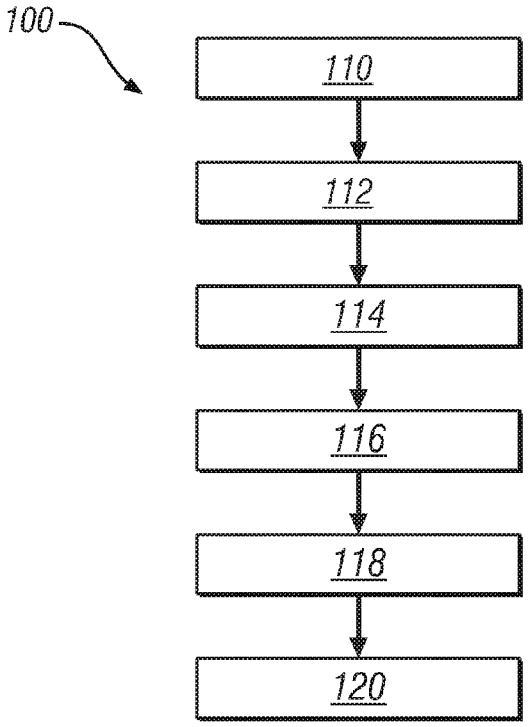
FIG. 16 shows a control scheme executed to control an internal combustion engine using the concepts described herein, in accordance with the disclosure.

An engine control scheme for operating the internal combustion engine is described in FIG. 16 that includes adjusting the initial spark timing to change engine torque output in response to changes in engine load. The engine load is described in terms of the operator torque request and includes various engine loads including, e.g., accessory loads, driveline loads due to changes including vehicle weight and road surface incline, and operator torque requests for acceleration and deceleration. During ongoing engine operation, the operator torque request is monitored, and a commanded air/fuel ratio responsive to the operator torque request is determined Under some circumstances, the commanded air/fuel ratio is stoichiometry, and may instead be rich of stoichiometry or lean of stoichiometry. An initial spark timing is selected using the spark map 35 shown with reference to FIG. 1, and corresponds to an engine operating point at a reference air/fuel ratio, e.g., stoichiometry. When a commanded air/fuel ratio associated with an engine operating point includes operating at a rich air/fuel ratio, i.e., at an equivalence ratio that is greater than 1.0, the initial spark timing is adjusted as described herein.

The control scheme determines a change in a combustion charge flame speed corresponding to the commanded air/fuel ratio, the process of which is described with reference to FIG. 2 and FIGS. 3-7.

The control scheme then determines a change in combustion timing correlated to the change in the combustion charge flame speed, which is described with reference to FIG. 8.

The control scheme then determines a spark timing compensation correlated to the change in combustion timing, which is described with reference to FIGS. 9-12.

The initial spark timing is adjusted using the spark timing compensation, correlated to the commanded air/fuel ratio or equivalence ratio, as is described with reference to FIGS. 13 and 14. Thus, spark timing for operating the engine is controlled using the initial spark timing adjusted with the spark timing compensation. As such, a spark-ignition internal combustion engine may be controlled by controlling spark ignition timing responsive to a combustion charge flame speed corresponding to the engine operating point and the commanded air/fuel ratio associated with the operator torque request.

The analytical process described herein with reference to FIGS. 2-15 is described with reference to engine operating data from a common data set collected using a representative engine operating on an engine dynamometer at specific operating points over a range of engine operating conditions measured in terms of air/fuel ratio, engine speed, and engine load.

Figure 2:
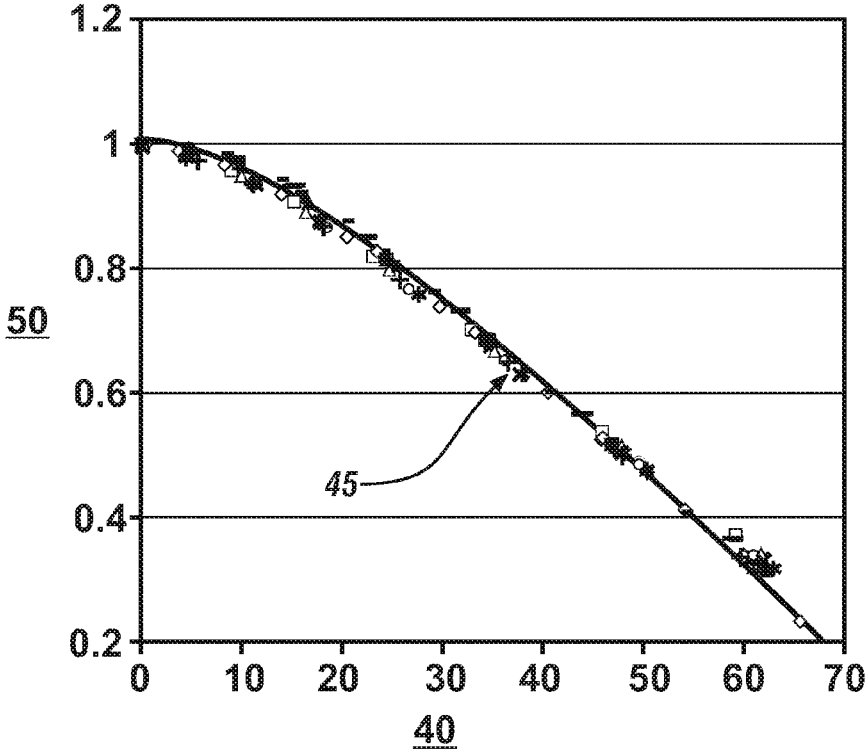
FIG. 2 shows a two-dimensional graphical representation of combustion retard data associated with operating an exemplary spark-ignition engine, in accordance with the disclosure.

FIG. 2 shows a two-dimensional graphical representation of representative engine data (45) associated with operating an exemplary spark-ignition engine, depicting a relationship between engine torque correlated to combustion retard that is independent of air/fuel ratio. The horizontal axis shows combustion retard 40 and the vertical axis shows normalized torque 50, and the representative engine data (45) includes data associated with operating a representative engine at different engine loads or torque outputs across a range of air/fuel ratios. Normalized torque is a measure of actual engine output torque (Actual Torque) as a ratio of a maximum achievable engine output torque (MBT Torque) at the speed/load operating point. The maximum achievable engine output torque (MBT Torque) is the maximum engine output torque when operating the representative engine at stoichiometry and a spark advance associated with the maximum brake torque (MBT). Thus, the representative engine data (45) indicates that normalized torque correlates to combustion retard. Normalized torque is calculated as follows.

$$\text{Normalized Torque}=\text{Actual Torque}/\text{MBT Torque} \quad [1]$$

Combustion timing is a term used to describe a state of an engine parameter that is associated with combustion. One exemplary engine parameter associated with combustion timing is a CA50 point, which is an engine crank angle corresponding to a 50% mass-burn-fraction of a combustion charge, with the engine crank angle corresponding to a position of a piston in a combustion chamber associated with the combustion charge.

Combustion retard is a change in the combustion timing relative to an initial combustion timing, and is a measure of delay or retard in the initial combustion timing. In one embodiment the initial combustion timing is a combustion timing that results in a maximum achievable engine output torque at the speed/load operating point when the engine is operating at the minimum spark advance before top-dead center (bTDC) that achieves a maximum brake torque (MBT), preferably measured when operating at a stoichiometric air/fuel ratio (MBT CA50). There is a corresponding CA50 point associated with actual engine output torque (Actual CA50). The combustion retard is an arithmetic difference between the aforementioned combustion timing points, and is calculated as follows.

$$\text{Combustion Retard}=\text{Actual CA50}-\text{MBT CA50} \quad [2]$$

The representative engine data (45) includes results associated with operating a representative spark-ignition engine on an engine dynamometer at specific operating points over a range of engine operating conditions measured in terms of air/fuel ratio, engine speed and engine load. The results correspond to engine operating points including engine speeds of 1200 RPM and 2000 RPM, and engine air/fuel ratios including stoichiometry, 13.4:1, 12.7:1, 12.1:1, 11.6:1, 10.8:1, and 10.0:1. The magnitude of the combustion retard may be correlated with the normalized engine torque using a polynomial equation.

As described herein, combustion retard is linked with an engine control parameter, e.g., spark timing, over a range of engine air/fuel ratios as a function of the engine speed and engine load. Spark retard is an offset term that is added to a spark advance setting 30 determined using the spark map 35 to control engine operation, including controlling engine operation when the engine is operating rich of stoichiometry.

Figure 3:
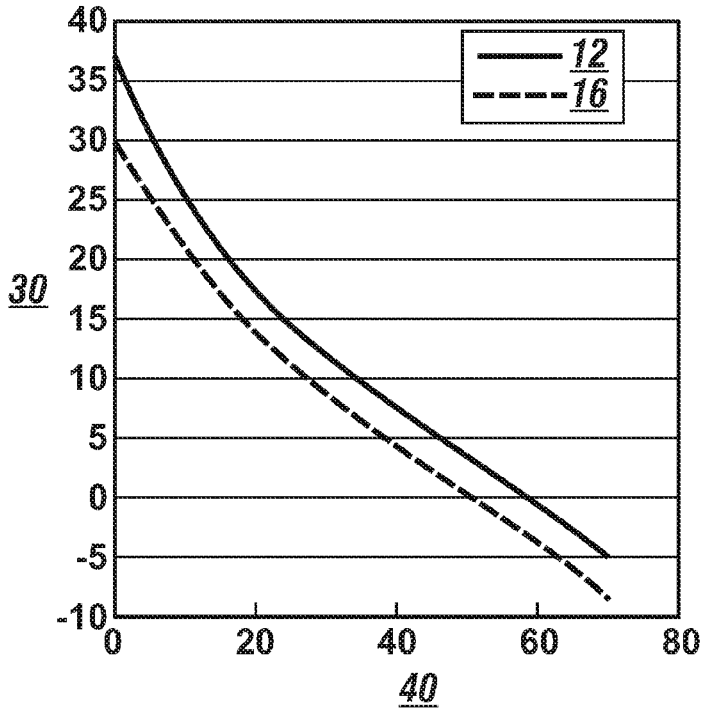
FIG. 3 shows a two-dimensional graphical representation of engine data showing spark timing correlated to combustion retard, in accordance with the disclosure.
Figure 4:
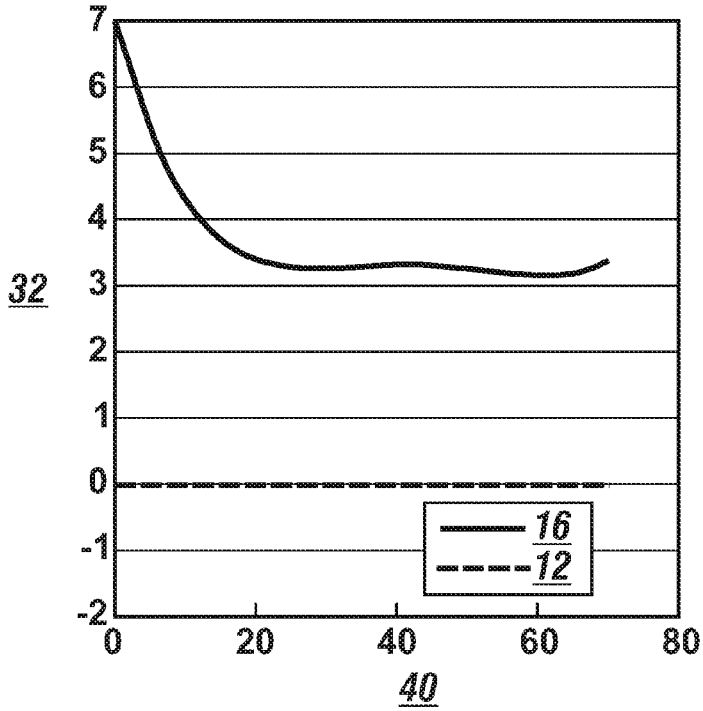
FIG. 4 shows a two-dimensional graphical representation of engine data including spark timing compensation in crank angle degrees corresponding to combustion retard, in accordance with the disclosure.
Figure 5:
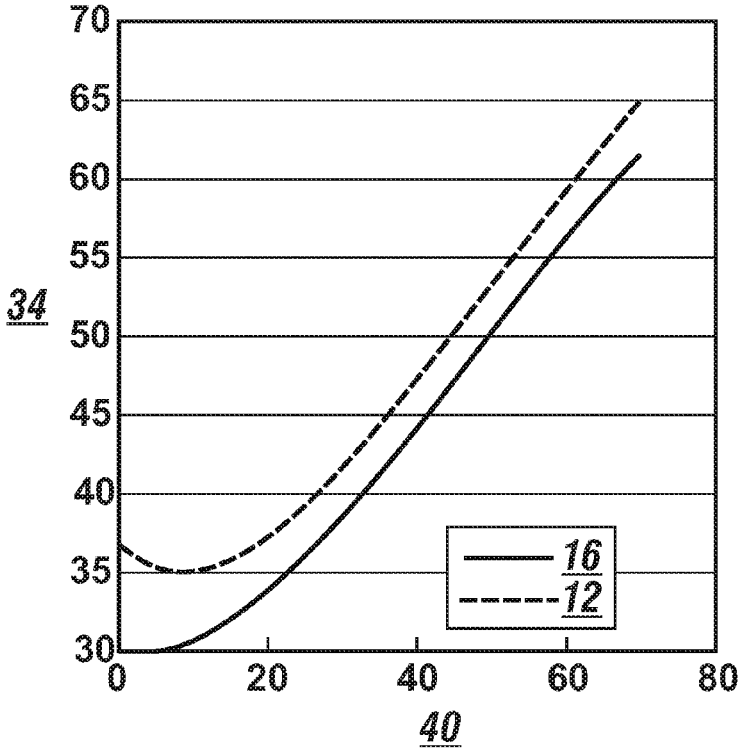
FIG. 5 shows a two-dimensional graphical representation of engine data including a duration in crank angle degrees between initiating a spark ignition event and a corresponding 50% mass-burn-fraction point correlated to combustion retard, in accordance with the disclosure.

FIGS. 3, 4, and 5 depict an analytical conversion of spark timing to a combustion timing event that can be correlated to the magnitude of combustion retard. The combustion timing event is a 50% mass-burn-fraction point as described herein.

FIG. 3 shows a two-dimensional graphical representation of a portion of the representative engine data (45) showing spark timing 30 correlated to combustion retard 40. The portion of the representative engine data (45) described herein includes operation at stoichiometry (12) and at a selected rich air/fuel ratio point (16), which is an air/fuel ratio of 11.6 as depicted. As is appreciated, the spark timing 30 is a measure of timing of initiating a spark ignition event, measured in crank angle degrees (bTDC).

FIG. 4 shows a two-dimensional graphical representation of a portion of the representative engine data (45) including spark timing compensation 32 in crank angle degrees corresponding to combustion retard 40. The portion of the representative engine data (45) described herein includes operation at stoichiometry (12) and at a selected rich air/fuel ratio point (16), which is an air/fuel ratio of 11.6 as depicted. Spark timing compensation 32 is achieved by arithmetically subtracting the spark timing engine data at stoichiometry (12) from the corresponding spark timing engine data at the selected rich air/fuel ratio point (16). As such, spark timing compensation 32 associated with operating at stoichiometry (12) is always zero.

FIG. 5 shows a two-dimensional graphical representation of a portion of the representative engine data (45) including a duration in crank angle degrees between initiating a spark ignition event and a corresponding combustion timing event, e.g., a 50% mass-burn-fraction point 34, correlated to combustion retard 40. This is also referred to as combustion duration. The portion of the representative engine data (45) described herein includes operation at stoichiometry (12) and at the selected rich air/fuel ratio point (16), which is an air/fuel ratio of 11.6 as depicted. The duration between initiating the spark ignition event and the corresponding 50% mass-burn-fraction point 34 is achieved by arithmetically adding the timing of initiating the spark ignition event, shown with reference to FIG. 3, with an engine crank angle associated with the corresponding 50% mass-burn-fraction point, at stoichiometry (12) and at the selected rich air/fuel ratio point (16).

Figure 6:
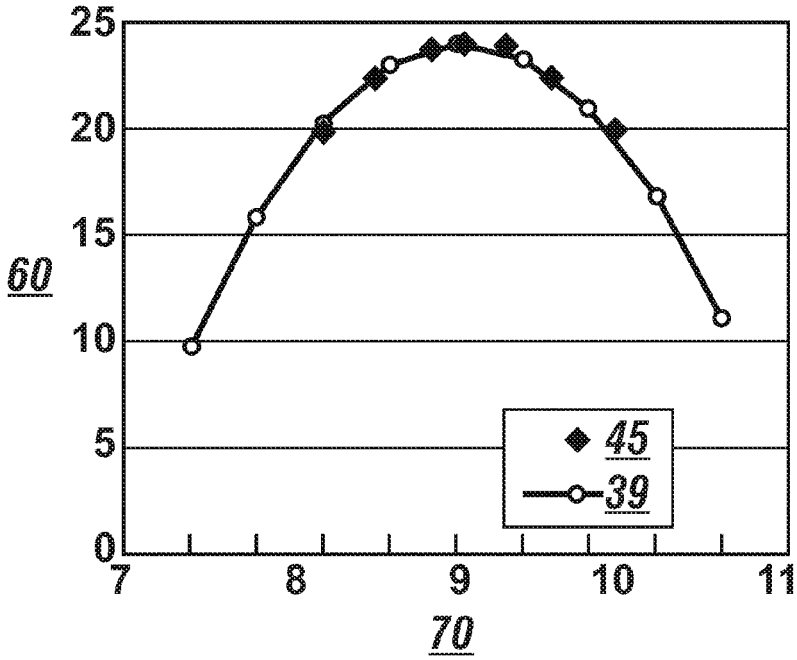
FIG. 6 shows a two-dimensional graphical representation of engine operating data for an exemplary spark-ignition engine, plotted to depict a representative flame speed (RFS) corresponding to air/fuel ratio, in accordance with the disclosure.

FIG. 6 shows a two-dimensional graphical representation of a portion of the representative engine data (45) and corresponding data developed using a mathematical model (39), plotted to depict a representative flame speed (RFS) 60 corresponding to air/fuel ratio 70. The portions of the representative engine data (45) described include operating points at engine speeds of 1200 RPM and 2000 RPM. The corresponding data developed using the mathematical model (39) is determined using a relationship between the representative flame speed (RFS) and the air/fuel ratio (AF), which is expressed as Eq. 3, with A, B, and C representing scalar terms. It is appreciated that numerical values of the scalar terms are developed for a specific application.

$$\mathrm{RFS}=A-B*(\mathrm{AF}-C)^2 \quad [3]$$

Figure 7:
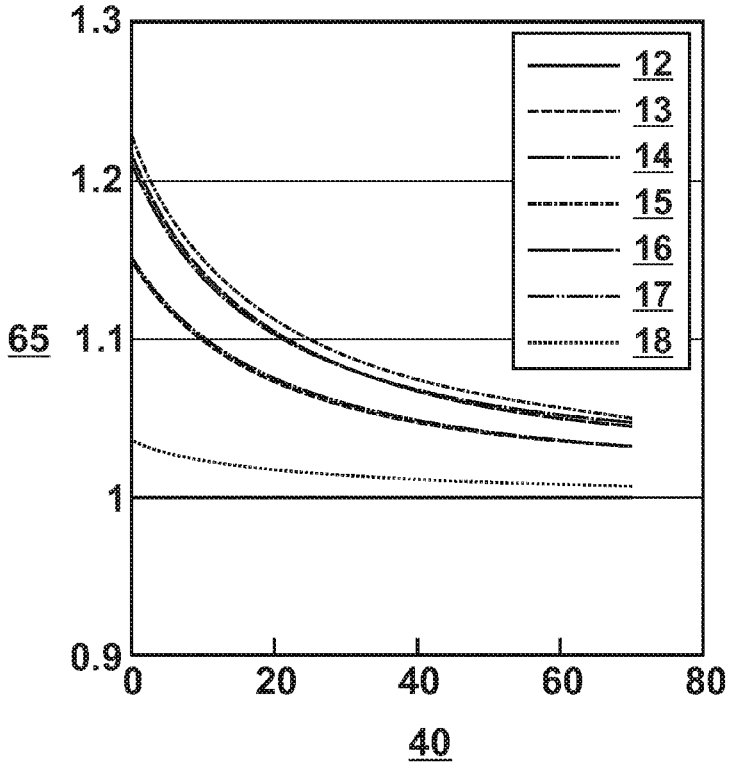
FIG. 7 shows a two-dimensional graphical representation of engine operating data plotted to depict an effective relative flame speed corresponding to combustion retard, in accordance with the disclosure.

FIG. 7 shows a two-dimensional graphical representation of a portion of the representative engine data (45) plotted to depict an effective relative flame speed 65 corresponding to combustion retard 40 at different air/fuel ratios. The representative engine data (45) includes results associated with operating at specific operating points over a range of engine operating conditions measured in terms of air/fuel ratio. The representative engine data (45) includes operating at air/fuel ratios including stoichiometry (12), 13.4:1 (13), 12.7:1 (14), 12.1:1 (15), 11.6:1 (16), 10.8:1 (17), and 10.0:1(18). The effective relative flame speed (SF) 65 may be determined using Eq. 4, and is based upon a relation between the air/fuel ratio (AF), the representative flame speed at stoichiometry ($RFS_{STOICH}$) and representative flame speed at the selected air/fuel ratio ($RFS_{AF}$) described with reference to FIG. 6, as follows:

$$SF=\frac{(RFS_{AF}+K)+(CA50-MBTCA50)}{(RFS_{STOICH}+K)+(CA50-MBTCA50)} \quad (4)$$

wherein the minimum spark advance for maximum brake torque (MBTCA50) and the engine crank angle corresponding to a 50% mass-burn-fraction of a combustion charge (CA50) are as previously described, and K is a model constant, which is a tuning parameter around zero to shift up the representative flame speed. The effective relative flame speed 65 is preferably normalized around stoichiometry, as is shown. The forgoing analysis may thus be used to estimate a change in a combustion charge flame speed associated with a difference between a reference air/fuel ratio, e.g., stoichiometry, and a commanded air/fuel ratio.

The data representing the duration between initiating a spark ignition event and a corresponding 50% mass-burn-fraction point 34 (described in FIG. 5) is combined with the effective relative flame speed 65 (described in FIGS. 6 and 7) at corresponding magnitudes of combustion retard. This yields the relationship shown in FIG. 8. Thus, a change in combustion timing, i.e., combustion retard, correlates to the change in the combustion charge flame speed.

Figure 8:
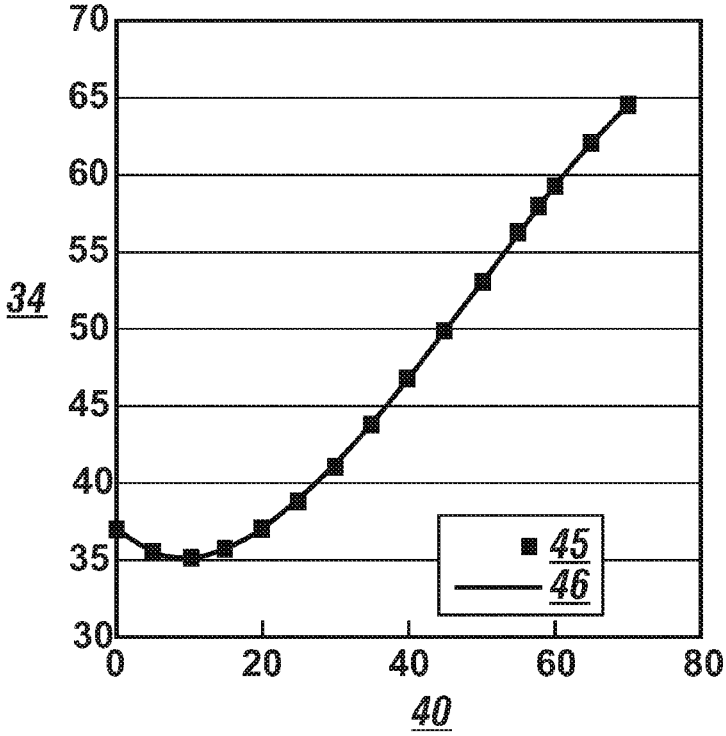
FIG. 8 shows a two-dimensional graphical representation of engine data for an exemplary spark-ignition engine, plotted to depict a relationship between a duration between a spark ignition event and a corresponding 50% mass-burn-fraction point and combustion retard, in accordance with the disclosure.

FIG. 8 shows a two-dimensional graphical representation of a relationship between a representative 50% mass-burn-fraction duration 34 in CA degrees and combustion retard 40 for the representative engine data (45). The representative 50% mass-burn-fraction duration 34 is the duration between a spark ignition event and a corresponding 50% mass-burn-fraction point. The results indicate that a change in the effective relative flame speed correlates to a change in combustion timing, i.e., combustion retard. The results indicate that the relationship between the representative 50% mass-burn-fraction duration 34 and combustion retard 40 is independent of engine speed or air/fuel ratio. This relationship between the duration between the spark ignition event and a corresponding 50% mass-burn-fraction point 34 and combustion retard 40 may be expressed as a polynomial equation as follows:

$$y=Ax^4+Bx^3+Cx^2+Dx+E \quad [5]$$

wherein the y term represents the representative 50% mass-burn-fraction duration 34, the x term represents combustion retard 40, and A, B, C, D, and E are factors determined for a specific application using representative data, e.g., the representative engine data (45). The graph depicts results (46) for model data using Eq. 5 and the representative engine data (45). Thus, a change in combustion timing correlates to the change in the combustion charge flame speed.

The relationship expressed in Eq. 5 between the representative 50% mass-burn-fraction duration 34 and combustion retard 40 is transformed to a relationship of combustion retard 40 correlated to spark timing compensation 32, as follows with reference to FIGS. 9-11.

Figure 9:
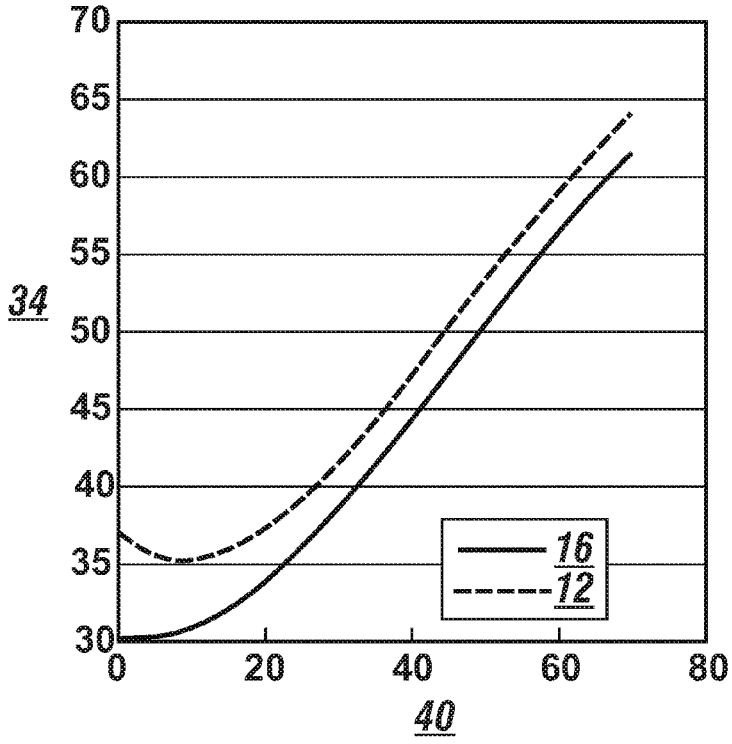
FIG. 9 shows a two-dimensional graphical representation of a relationship between a duration between a spark ignition event and a corresponding 50% mass-burn-fraction point corresponding to combustion retard at stoichiometry and at a selected rich air/fuel ratio point, in accordance with the disclosure.

FIG. 9 shows a two-dimensional graphical representation of the relationship between the representative 50% mass-burn-fraction duration 34 corresponding to combustion retard 40, at stoichiometry (12) and at a selected rich air/fuel ratio point (16), which is an air/fuel ratio of 11.6 as depicted. The relationship between the representative 50% mass-burn-fraction duration 34 corresponding to combustion retard 40 is derived using the effective relative flame speed corresponding to combustion retard shown herein at FIGS. 6 and 7, the relationship between the representative 50% mass-burn-fraction duration 34 corresponding to combustion retard shown herein at FIG. 7, and the relationship between the representative 50% mass-burn-fraction duration 34 and combustion retard 40, as expressed in Eq. 5 and shown herein at FIG. 8.

The relation shown in FIG. 9 allows calculation of a representative 50% mass-burn-fraction duration for a selected air/fuel ratio by dividing the relationship between the duration between a spark ignition event and a corresponding 50% mass-burn-fraction point in FIG. 8 with the effective relative flame speed determined with reference to FIG. 7.

Figure 10:
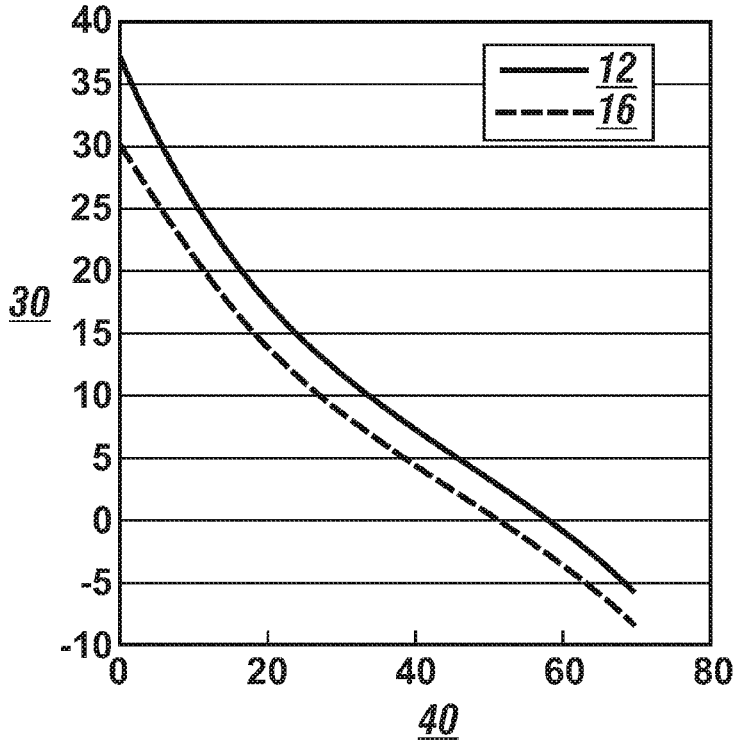
FIG. 10 shows a two-dimensional graphical representation of a relationship between spark timing and combustion retard at stoichiometry and at a selected rich air/fuel ratio point, in accordance with the disclosure.

FIG. 10 shows a two-dimensional graphical representation of the relationship between spark timing 30 and combustion retard 40, at stoichiometry (12) and at a selected rich air/fuel ratio point (16), which is an air/fuel ratio of 11.6 as depicted.

As such, the duration between a spark ignition event and a corresponding 50% mass-burn-fraction point for a selected air/fuel ratio is converted to an actual spark timing by arithmetically subtracting combustion retard, shown at stoichiometry (12) and at a selected rich air/fuel ratio point (16) which is an air/fuel ratio of 11.6:1 as depicted.

Figure 11:
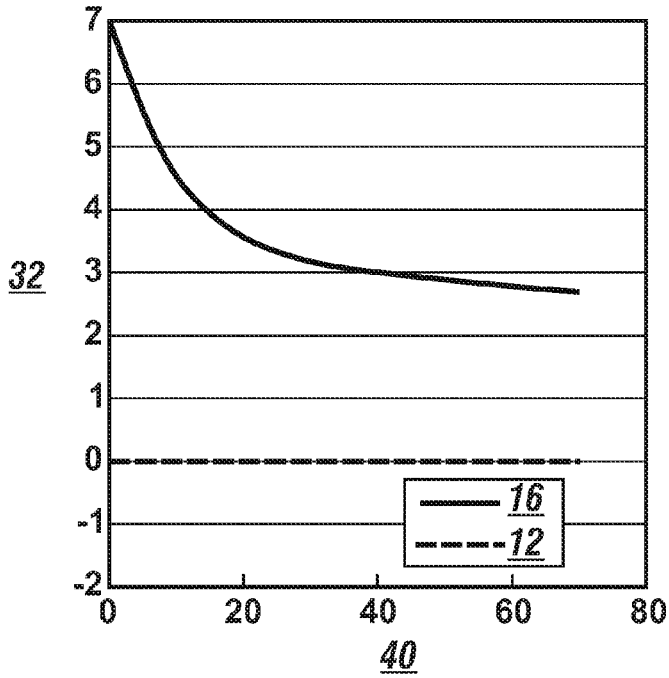
FIG. 11 shows a two-dimensional graphical representation of a relationship between spark timing compensation corresponding to combustion retard at stoichiometry and at a selected rich air/fuel ratio point, in accordance with the disclosure.

FIG. 11 shows a two-dimensional graphical representation of the relationship depicting spark timing compensation 32 corresponding to combustion retard 40, at stoichiometry (12) and at a selected rich air/fuel ratio point (16), which is an air/fuel ratio of 11.6 as depicted. Spark timing compensation 32 corresponding to combustion retard 40 is that which is required to account for changes in the combustion charge flame charge and in-cylinder combustion timing associated with operation at the non-stoichiometric air/fuel ratio.

Figure 12:
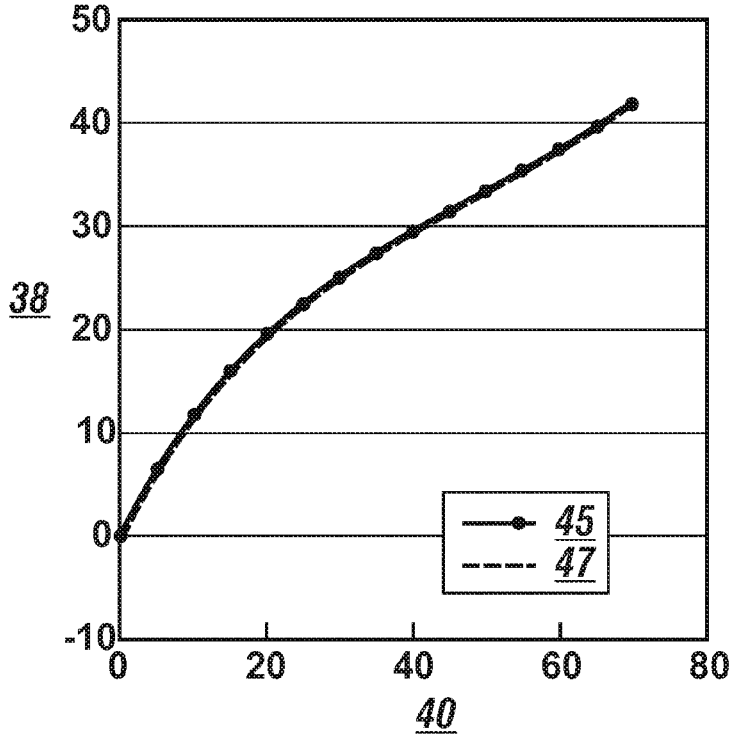
FIG. 12 shows spark retard relative to MBT timing corresponding to combustion retard for the representative engine data, in accordance with the disclosure.

FIG. 12 shows the representative engine data (45) including spark retard relative to MBT timing 38, in crank angle degrees, corresponding to combustion retard 40, thus depicting a coordinate transformation between the spark retard relative to MBT timing 38 and the combustion retard 40. This relationship between the spark retard relative to MBT timing 38 and combustion retard 40 may be expressed as a polynomial equation as follows:

$$y=Mx^3+Nx^2+Px+Q \quad [6]$$

wherein the y term represents the spark retard relative to MBT timing 38, the x term represents combustion retard 40, and M, N, P, and Q are factors determined for a specific application using representative data. The y term derived using the model of Eq. 6 is plotted (47) at selected values for combustion retard 40.

Figure 13:
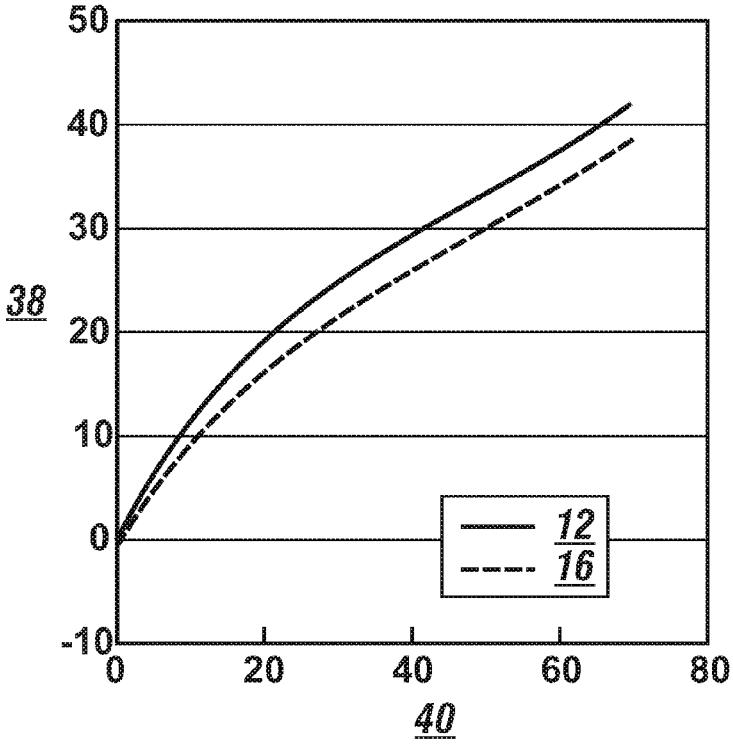
FIG. 13 shows spark retard relative to MBT timing corresponding to combustion retard at selected air/fuel ratios of stoichiometry and at a selected rich air/fuel ratio point, in accordance with the disclosure.

FIG. 13 shows spark retard relative to MBT timing 38, in crank angle degrees, corresponding to combustion retard 40 at selected air/fuel ratios of stoichiometry (12) and at the selected rich air/fuel ratio point (16), which is an air/fuel ratio of 11.6 as depicted. The results depict a coordinate transformation between the spark retard and the combustion retard by dividing the results depicted in FIG. 12 by the effective relative flame speed (shown with reference to FIG. 7 and Eq. 4) and the associated air/fuel ratio. This analysis is used to determine change in combustion timing corresponding to the change in the combustion charge flame speed that is associated with and corresponds to a difference between the reference and commanded air/fuel ratios.

Figure 14:
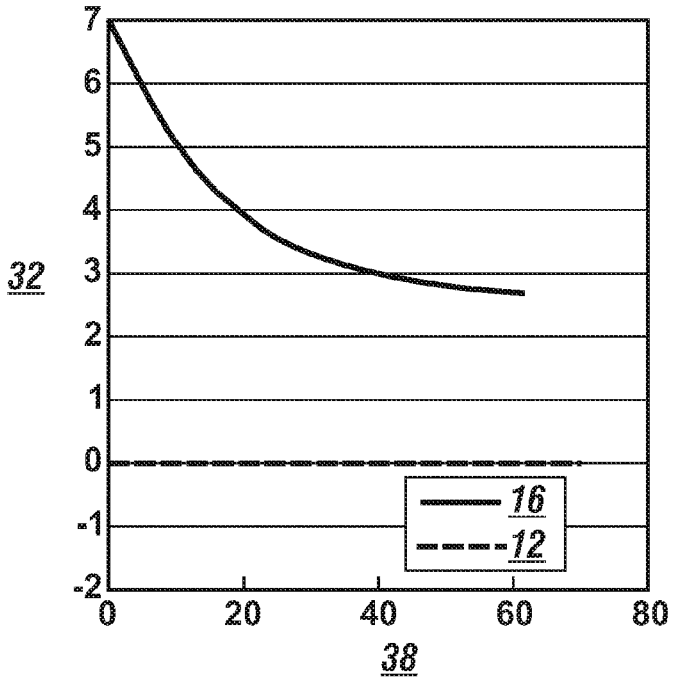
FIG. 14 shows spark timing compensation plotted as a function of spark retard relative to MBT timing at stoichiometry and at a selected rich air/fuel ratio point, in accordance with the disclosure.

FIG. 14 depicts the data shown with reference to FIG. 13 transformed to show spark timing compensation 32 plotted as a function of spark retard relative to MBT timing 38, at stoichiometry (12) and at the selected rich air/fuel ratio point (16), which is an air/fuel ratio of 11.6 as depicted. This analysis is used to determine a spark timing compensation corresponding to change in the combustion timing.

Figure 15:
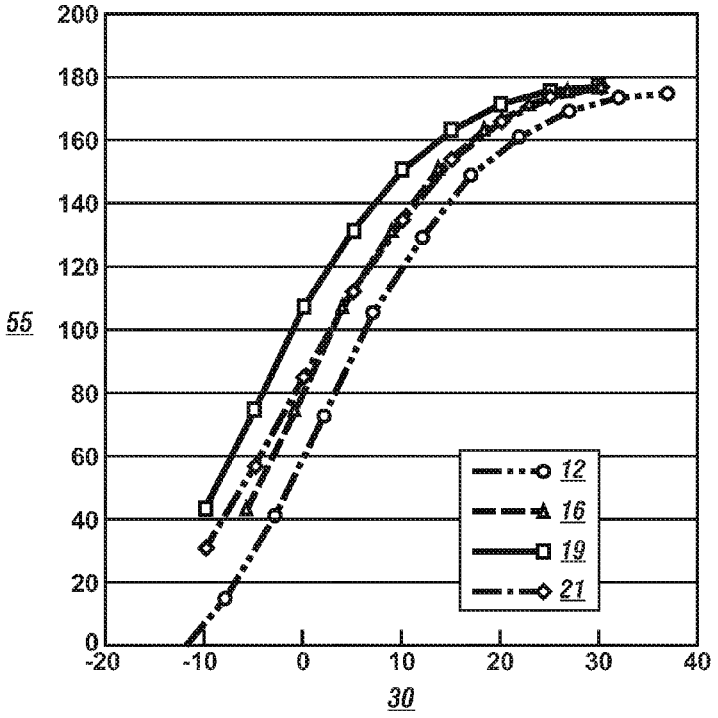
FIG. 15 shows data depicting actual and predicted torque output plotted as a function of spark timing at stoichiometry and at a selected rich air/fuel ratio point, in accordance with the disclosure.

FIG. 15 shows a two-dimensional graphical representation of the relationship depicting engine torque output 55 plotted as a function of spark timing 30. Portions of the representative engine data associated with operating an exemplary engine at stoichiometry (12) and at a selected rich air/fuel ratio point (16), which is an air/fuel ratio of 11.6 as depicted, are shown. Predicted data for torque output using a known model is shown (19). Predicted data for torque output using the model described herein is shown (21), indicating a close correlation to the representative engine data operating at the selected rich air/fuel ratio point (16). As is appreciated, the spark timing for an engine may be controlled using the initial spark timing adjusted with the spark timing compensation that is derived as described herein.

FIG. 16 shows a control scheme 100 that may be executed to control an internal combustion engine using the concepts described herein. The control scheme 100 is regularly executing during ongoing engine operation, preferably for each combustion event. During ongoing engine operation an operator torque request is monitored along with an engine operating point described in terms of engine speed and load (110). An initial spark advance setting is selected using the spark map 35 set forth in FIG. 1 based upon the engine operating point (112). A commanded air/fuel ratio corresponding to the operator torque request is monitored or otherwise determined (114). A change in a combustion charge flame speed associated with a difference between the commanded air/fuel ratio and a reference air/fuel ratio, e.g., stoichiometry is estimated (116). In one embodiment the difference between the commanded air/fuel ratio and the reference air/fuel ratio is expressed as an equivalence ratio. A change in in-cylinder combustion timing is determined as a function of the change in the combustion charge flame speed associated with the difference between the commanded air/fuel ratio and the reference air/fuel ratio (118). A spark timing compensation may be determined as a function of the change in in-cylinder combustion timing, and spark timing is adjusted from the initial spark advance setting using the spark timing compensation (120). This control scheme 100 allows the engine control system to increase engine torque output during operation at non-stoichiometric operating conditions by accounting for changes in the combustion charge flame speed and in-cylinder combustion timing associated with operation at the non-stoichiometric air/fuel ratio.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for operating a spark-ignition internal combustion engine comprises controlling spark ignition timing by determining an initial spark timing corresponding to an engine operating point, and adjusting the initial spark timing using a spark timing compensation, where the spark timing compensation is determined by a change in combustion charge flame speed corresponding to the engine operating point and a commanded air/fuel ratio associated with an operator torque request.

2. Method for operating a spark-ignition internal combustion engine, comprising:

determining an initial spark timing corresponding to an engine operating point;

determining a commanded air/fuel ratio corresponding to an engine load;

determining a change in a combustion charge flame speed corresponding to the commanded air/fuel ratio;

determining a change in a combustion timing corresponding to the change in the combustion charge flame speed;

determining a spark timing compensation corresponding to the change in the combustion timing; and adjusting the initial spark timing using the spark timing compensation.

3. The method of claim 2, wherein determining the change in the combustion charge flame speed corresponding to the commanded air/fuel ratio comprises:

determining a representative flame speed correlated to the commanded air/fuel ratio; and determining an effective relative flame speed corresponding to the representative flame speed.

4. The method of claim 3, wherein determining the representative flame speed correlated to the commanded air/fuel ratio comprises determining the representative flame speed in accordance with the following relationship:

$$RFS=A-B*(AF-C)^2,$$

wherein RFS is the representative flame speed and AF is the commanded air/fuel ratio, and A, B, and C are scalar terms.

5. The method of claim 3, wherein determining the effective relative flame speed corresponding to the representative flame speed comprises determining the effective relative flame speed in accordance with the following relationship:

$$SF = \frac{(RFS_{AF} + K) + (CA50 - MBTCA50)}{(RFS_{STOICH} + K) + (CA50 - MBTCA50)}$$

wherein SF is the effective relative flame speed,

AF is the commanded air/fuel ratio, $RFS_{STOICH}$ is a representative flame speed at stoichiometry, $RFS_{AF}$ is a representative flame speed at the commanded air/fuel ratio, MBTCA50 is an engine crank angle associated with a 50% mass-burn-fraction when spark timing is controlled to a minimum spark advance for maximum brake torque, CA50 is an engine crank angle associated with a 50% mass-burn-fraction of a combustion charge, and K is a scalar term.

6. The method of claim 2, wherein determining the change in the combustion timing corresponding to the change in the combustion charge flame speed comprises:

determining a duration between initiating a spark ignition event and a corresponding 50% mass-burn-fraction point correlated to a combustion retard;

determining a representative flame speed correlated to the commanded air/fuel ratio;

determining an effective relative flame speed corresponding to the representative flame speed; and determining the change in the combustion timing corresponding to the effective relative flame speed and the duration between initiating the spark ignition event and the corresponding 50% mass-burn-fraction point correlated to the change in combustion timing.

7. The method of claim 2, wherein determining the commanded air/fuel ratio corresponding to the engine load comprises determining the commanded air/fuel ratio based upon an operator torque request.

8. The method of claim 2, wherein determining the change in the combustion charge flame speed corresponding to the commanded air/fuel ratio comprises determining a change in the combustion charge flame speed based upon a difference between a reference air/fuel ratio and the commanded air/fuel ratio.

9. Method for controlling a spark timing in a spark-ignition internal combustion engine, comprising:

determining a commanded air/fuel ratio corresponding to an operator torque request;

determining a change in a combustion charge flame speed corresponding to the commanded air/fuel ratio;

determining a change in a combustion timing corresponding to the change in the combustion charge flame speed;

determining a spark timing compensation corresponding to the change in the combustion timing; and adjusting the spark timing for an engine operating point using the spark timing compensation.

10. The method of claim 9, wherein determining the change in the combustion charge flame speed corresponding to the commanded air/fuel ratio comprises:

determining a representative flame speed correlated to the commanded air/fuel ratio; and determining an effective relative flame speed corresponding to the representative flame speed.

11. The method of claim 10, wherein determining the representative flame speed correlated to the commanded air/fuel ratio comprises determining the representative flame speed in accordance with the following relationship:

$$RFS=A-B*(AF-C)^2,$$

wherein RFS is the representative flame speed and AF is the commanded air/fuel ratio, and A, B, and C are scalar terms.

12. The method of claim 10, wherein determining the effective relative flame speed corresponding to the representative flame speed comprises determining the effective relative flame speed in accordance with the following relationship:

$$SF = \frac{(RFS_{AF} + K) + (CA50 - MBTCA50)}{(RFS_{STOICH} + K) + (CA50 - MBTCA50)}$$

wherein SF is the effective relative flame speed,

AF is the commanded air/fuel ratio, $RFS_{STOICH}$ is a representative flame speed at stoichiometry, $RFS_{AF}$ is a representative flame speed at the commanded air/fuel ratio, MBTCA50 is an engine crank angle associated with a 50% mass-burn-fraction when spark timing is controlled to a minimum spark advance for maximum brake torque, CA50 is an engine crank angle associated with a 50% mass-burn-fraction of a combustion charge, and K is a scalar term.

13. The method of claim 9, wherein determining the change in the combustion timing corresponding to the change in the combustion charge flame speed comprises:

determining a duration between initiating a spark ignition event and a corresponding 50% mass-burn-fraction point correlated to a combustion retard;

determining a representative flame speed correlated to the commanded air/fuel ratio;

determining an effective relative flame speed corresponding to the representative flame speed; and determining the change in the combustion timing corresponding to the effective relative flame speed and the duration between initiating the spark ignition event and the corresponding 50% mass-burn-fraction point correlated to the change in combustion timing.

* * * * *